US009817360B2

(12) United States Patent
Yamamura

(10) Patent No.: US 9,817,360 B2
(45) Date of Patent: Nov. 14, 2017

(54) IMAGE FORMING APPARATUS

(71) Applicant: FUJI XEROX CO., LTD., Tokyo (JP)

(72) Inventor: Tsutomu Yamamura, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/230,620

(22) Filed: Aug. 8, 2016

(65) Prior Publication Data

US 2017/0277115 A1 Sep. 28, 2017

(30) Foreign Application Priority Data

Mar. 22, 2016 (JP) ..... 2016-057473

(51) Int. Cl.
*G03G 21/16* (2006.01)

(52) U.S. Cl.
CPC ..... *G03G 21/1623* (2013.01)

(58) Field of Classification Search
CPC combination set(s) only.
See application file for complete search history.

(56) References Cited

U.S. PATENT DOCUMENTS

2005/0191080 A1 9/2005 Oguma et al.
2009/0162091 A1 6/2009 Yokoi

FOREIGN PATENT DOCUMENTS

JP 2003-195723 A 7/2003
JP 2005-275341 A 10/2005
JP 2009-157001 A 7/2009

*Primary Examiner* — Clayton E Laballe
*Assistant Examiner* — Jas Sanghera
(74) *Attorney, Agent, or Firm* — Sughrue Mion, PLLC

(57) ABSTRACT

An image forming apparatus includes an opening-closing member, which rotates to open or close an opening, an image carrier, an exposure member, a developing member, and a grounding member. The exposure member moves in response to a movement of the opening-closing member so as to be at an opposing position, at which the exposure member opposes the image carrier, when the opening-closing member is at a closed position and at a retracted position, at which the exposure member is retracted away from the image carrier, when the opening-closing member is at an open position. The exposure member forms an electrostatic latent image on the image carrier while the exposure member is at the opposing position. The developing member develops the electrostatic latent image. The grounding member grounds the exposure member at least when the exposure member is moving from the opposing position to the retracted position.

8 Claims, 12 Drawing Sheets

IMAGE FORMING APPARATUS

CROSS-REFERENCE TO RELATED APPLICATIONS

This application is based on and claims priority under 35 USC 119 from Japanese Patent Application No. 2016-057473 filed Mar. 22, 2016.

BACKGROUND

Technical Field

The present invention relates to an image forming apparatus.

SUMMARY

According to an aspect of the invention, there is provided an image forming apparatus including an opening-closing member that rotates to open or close an opening in a housing; an image carrier disposed in the housing; an exposure member disposed in the housing, the exposure member moving in response to an opening-closing movement of the opening-closing member so that the exposure member is at an opposing position, at which the exposure member opposes the image carrier, when the opening-closing member is at a closed position, at which the opening-closing member closes the opening in the housing and so that the exposure member is at a retracted position, at which the exposure member is retracted away from the image carrier, when the opening-closing member is at an open position, at which the opening-closing member opens the opening in the housing, the exposure member forming an electrostatic latent image by performing an exposure process on the image carrier while the exposure member is at the opposing position; a developing member that develops the electrostatic latent image; and a grounding member that grounds the exposure member at least when the exposure member is moving from the opposing position to the retracted position.

BRIEF DESCRIPTION OF THE DRAWINGS

An exemplary embodiment of the present invention will be described in detail based on the following figures, wherein.

DETAILED DESCRIPTION

Figure 1:
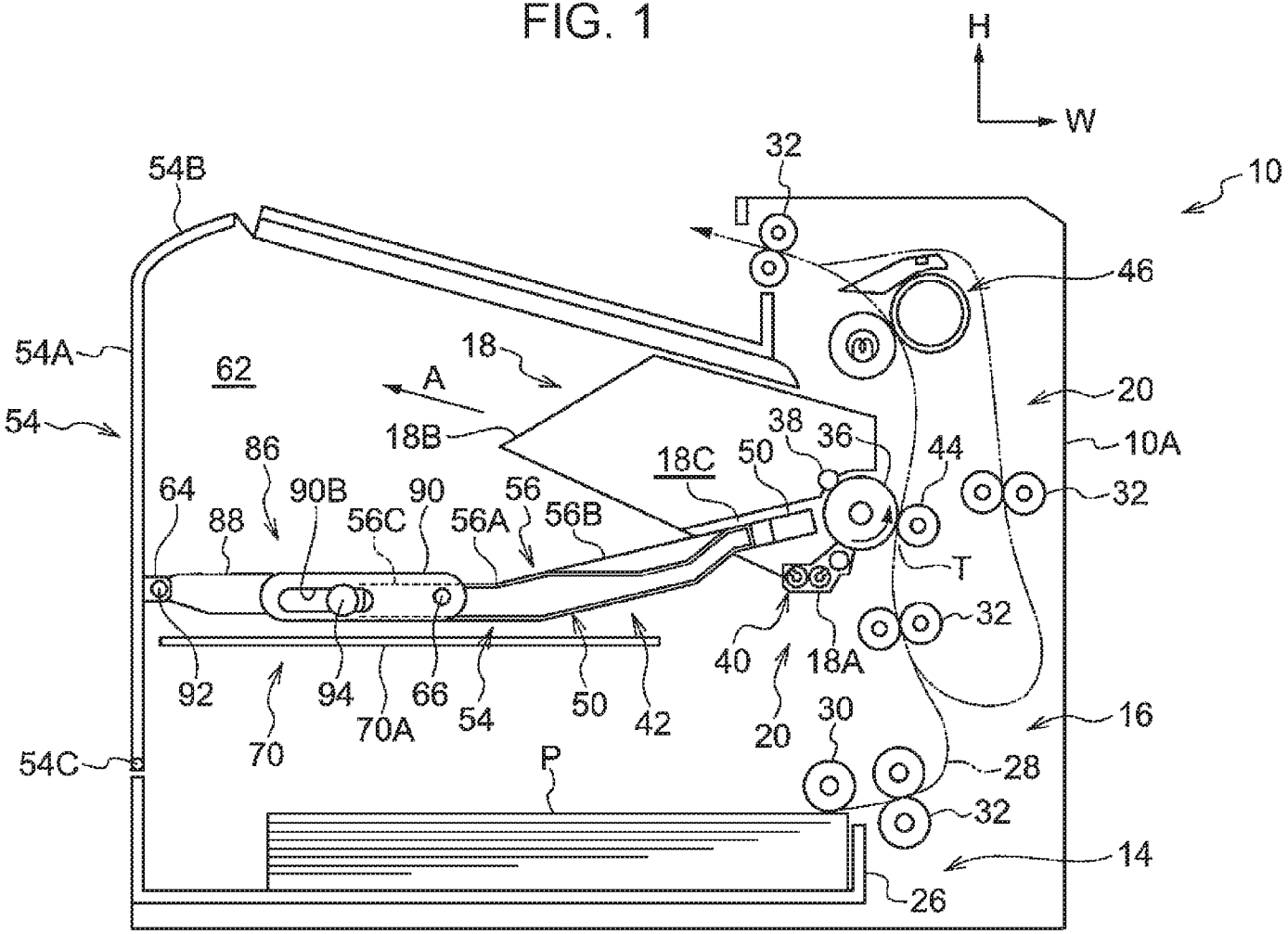
FIG. 1 is a schematic diagram illustrating an image forming apparatus according to an exemplary embodiment of the present invention.

An example of an image forming apparatus according to an exemplary embodiment of the present invention will be described with reference to FIGS. 1 to 12. In the drawings, the arrow H indicates the up-down direction of the apparatus (vertical direction), the arrow W indicates the width direction of the apparatus (horizontal direction), and the arrow D indicates the depth direction of the apparatus (horizontal direction).

Overall Structure

As illustrated in FIG. 1, an image forming apparatus 10 according to the exemplary embodiment includes, in order from the lower side toward the upper side in the up-down direction (direction of arrow H), a container section 14 that contains paper sheets P, which are an example of recording media; a transport section 16 that transports the paper sheets P contained in the container section 14; and an image forming section 20 that forms images on the paper sheets P transported from the container section 14 by the transport section 16.

Container Section

The container section 14 includes a container member 26 capable of being pulled out of a housing 10A of the image forming apparatus 10 toward a near side in the depth direction of the apparatus, and the paper sheets P are stacked on the container member 26. The container section 14 also includes a feed roller 30 that feeds the paper sheets P stacked on the container member 26 toward a transport path 28, which is included in the transport section 16.

Transport Section

The transport section 16 includes plural transport rollers 32 that transport each paper sheet P along the transport path 28.

Image Forming Section

The image forming section 20 includes an image forming unit 18, which is an example of an image forming section for forming a black toner image and which is detachably attached to an apparatus body, and an exposure unit 42, which is an example of an exposure member and which irradiates an image carrier 36 described, which will be described below, with exposure light. The image forming section 20 also includes a transfer roller 44, which transfers the toner image formed by the image forming unit 18 onto a paper sheet P, and a fixing device 46, which fixes the toner image to the paper sheet P by applying heat and pressure.

The image forming unit 18 includes the image carrier 36; a charging roller 38, which charges the surface of the image carrier 36; and a developing device 40, which develops an electrostatic latent image formed on the image carrier 36 into a visual toner image. The electrostatic latent image is formed as a result of the exposure unit 42 irradiating the image carrier 36 with the exposure light.

The image forming unit 18 includes a lower section 18A, which includes the developing device 40, and an upper section 18B, which includes the charging roller 38. The lower section 18A and the upper section 18B are connected to each other at both ends thereof in the depth direction of the apparatus, and a gap 18C is formed between the lower section 18A and the upper section 18B. A portion of the exposure unit 42 is disposed in the gap 18C.

The image forming unit 18 may be detached from the housing 10A by moving the image forming unit 18 in the direction of arrow A in FIG. 1.

A grounding member 68 for grounding the exposure unit 42 and the exposure unit 42 will be described in detail below.

Others

The image forming apparatus 10 also includes an opening-closing cover 54, which is an example of an opening-closing member that opens and closes an opening 62 in the housing 10A and enables the image forming unit 18 to be detached and attached while the opening 62 is opened; and link mechanisms 86, which move the exposure unit 42 in response to an opening-closing movement of the opening-closing cover 54. The opening-closing cover 54 and the link mechanisms 86 will be described in detail below.

Operation of Image Forming Apparatus

The image forming apparatus 10 forms an image in the following manner.

First, the charging roller 38, to which a voltage is applied, uniformly charges the surface of the image carrier 36 to a predetermined negative potential. Next, the exposure unit 42 irradiates the charged surface of the image carrier 36 with the exposure light on the basis of data input from an external device, thereby forming an electrostatic latent image.

Thus, an electrostatic latent image corresponding to the data is formed on the surface of the image carrier 36. Then, the developing device 40 develops the electrostatic latent image into a visual toner image.

The paper sheet P fed from the container member 26 to the transport path 28 by the feed roller 30 is transported to a transfer position T, at which the image carrier 36 and the transfer roller 44 are in contact with each other. At the transfer position T, at which the image carrier 36 and the transfer roller 44 are in contact with each other, the paper sheet P is transported while being sandwiched between the image carrier 36 and the transfer roller 44, so that the toner image on the surface of the image carrier 36 is transferred onto the paper sheet P.

The toner image that has been transferred onto the paper sheet P is fixed to the paper sheet P by the fixing device 46. Then, the paper sheet P to which the toner image has been fixed is ejected out of the housing 10A by the transport rollers 32.

The exposure unit 42, the grounding member 68, the opening-closing cover 54, and the link mechanisms 86 will now be described.

Exposure Unit

Referring to FIG. 1, the exposure unit 42 is disposed on one side of the image carrier 36 in the width direction of the apparatus (side close to the opening-closing cover 54 described below). The exposure unit 42 moves between an opposing position (see FIG. 1), at which the exposure unit 42 is capable of forming an electrostatic latent image on the surface of the image carrier 36, and a retracted position (see FIG. 3), at which the exposure unit 42 is retracted away from the image carrier 36 and is removed from the gap 18C in the image forming unit 18.

The exposure unit 42 includes a light-emitting diode (LED) print head 50 (hereinafter referred to as "head 50"), in which plural light-emitting elements are arranged in the depth direction of the apparatus, and a support member 56 that supports the head 50.

Head

Figure 12:
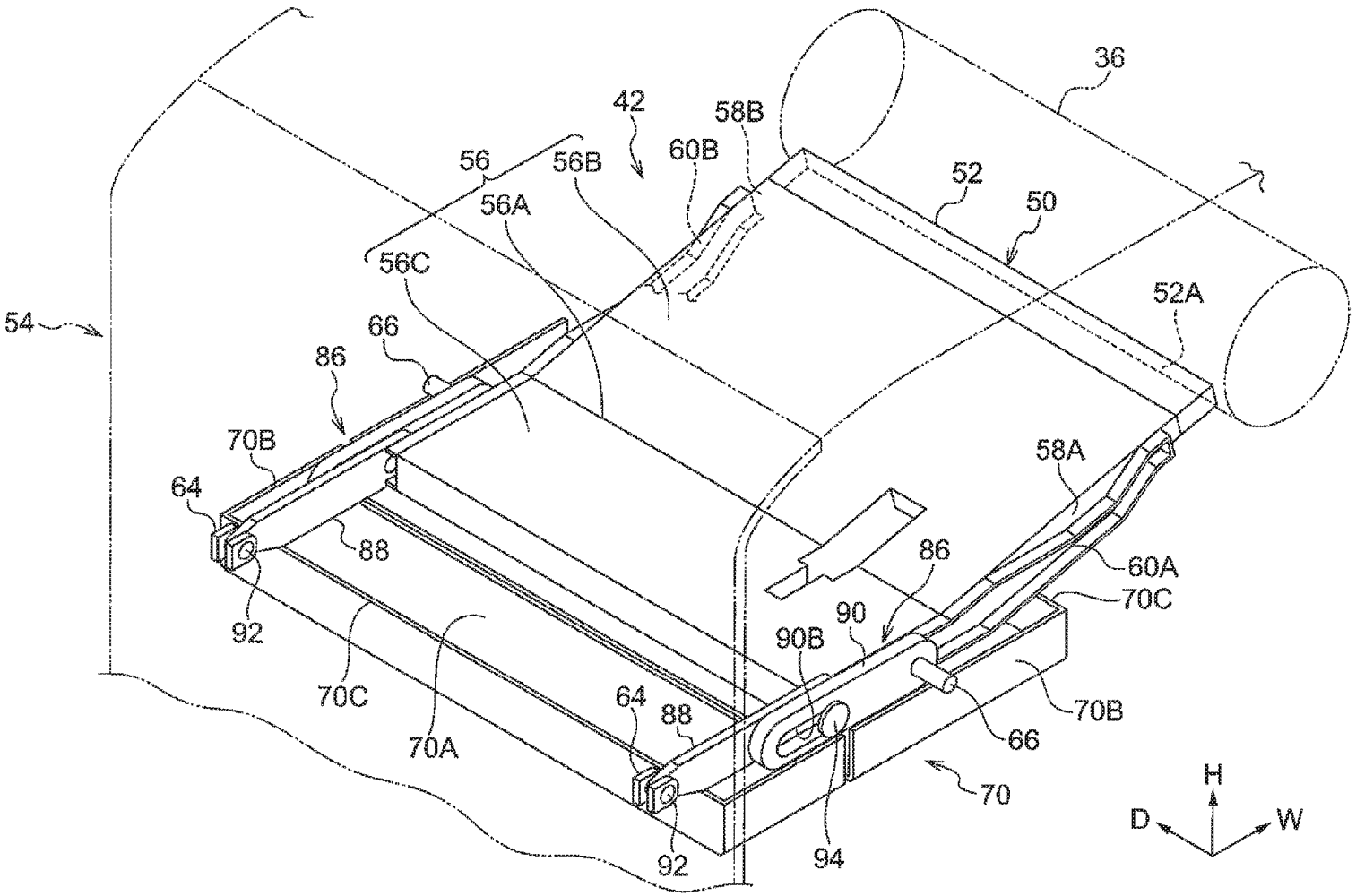
FIG. 12 is a perspective view of the exposure unit included in the image forming apparatus according to the exemplary embodiment of the present invention.

As illustrated in FIG. 12, the head 50 includes a housing 52 made of a metal, which has a rectangular shape in cross section and extends in the depth direction of the apparatus. In the state in which the exposure unit 42 is at the opposing position, the exposure light is emitted from an opposing surface 52A of the housing 52 that opposes the image carrier 36.

Support Member

The support member 56, which is made of a resin, is disposed so to oppose the image carrier 36 with the head 50 interposed therebetween (at a side close to the opening-closing cover 54 described below), and extends in the width direction of the apparatus. The support member 56 includes a bent portion 56A, which is bent when viewed in the depth direction of the apparatus, a first portion 56B, which is closer to the image carrier 36 than the bent portion 56A is, and a second portion 56C, which is farther from the image carrier 36 than the bent portion 56A is.

In the state in which the exposure unit 42 is at the opposing position, when viewed in the depth direction of the apparatus, the first portion 56B extends obliquely upward from the bent portion 56A, and the second portion 56C extends in the width direction of the apparatus.

The support member 56 also includes an end surface 58A that faces the near side in the depth direction of the apparatus, and an end surface 58B that faces the far side in the depth direction of the apparatus. A guide groove 60A, which extends in the width direction of the apparatus, is formed between ribs provided on the end surface 58A, and a guide groove 60B, which also extends in the width direction of the apparatus, is formed between ribs provided on the end surface 58B.

Distal end portions of plural guide pins (not shown), whose proximal end portions are attached to reinforcing members (not shown), are inserted into the guide grooves 60A and 60B in the depth direction of the apparatus from the outside. A rib 76 on which a second end portion 80B of a coil spring 80, which will be described below, is placed is formed on the support member 56 (see FIG. 11).

In this structure, the exposure unit 42 moves between the opposing position and the retracted position while being guided by the guide pins having the distal end portions inserted in the guide grooves 60A and 60B.

Grounding Member

Figure 4:
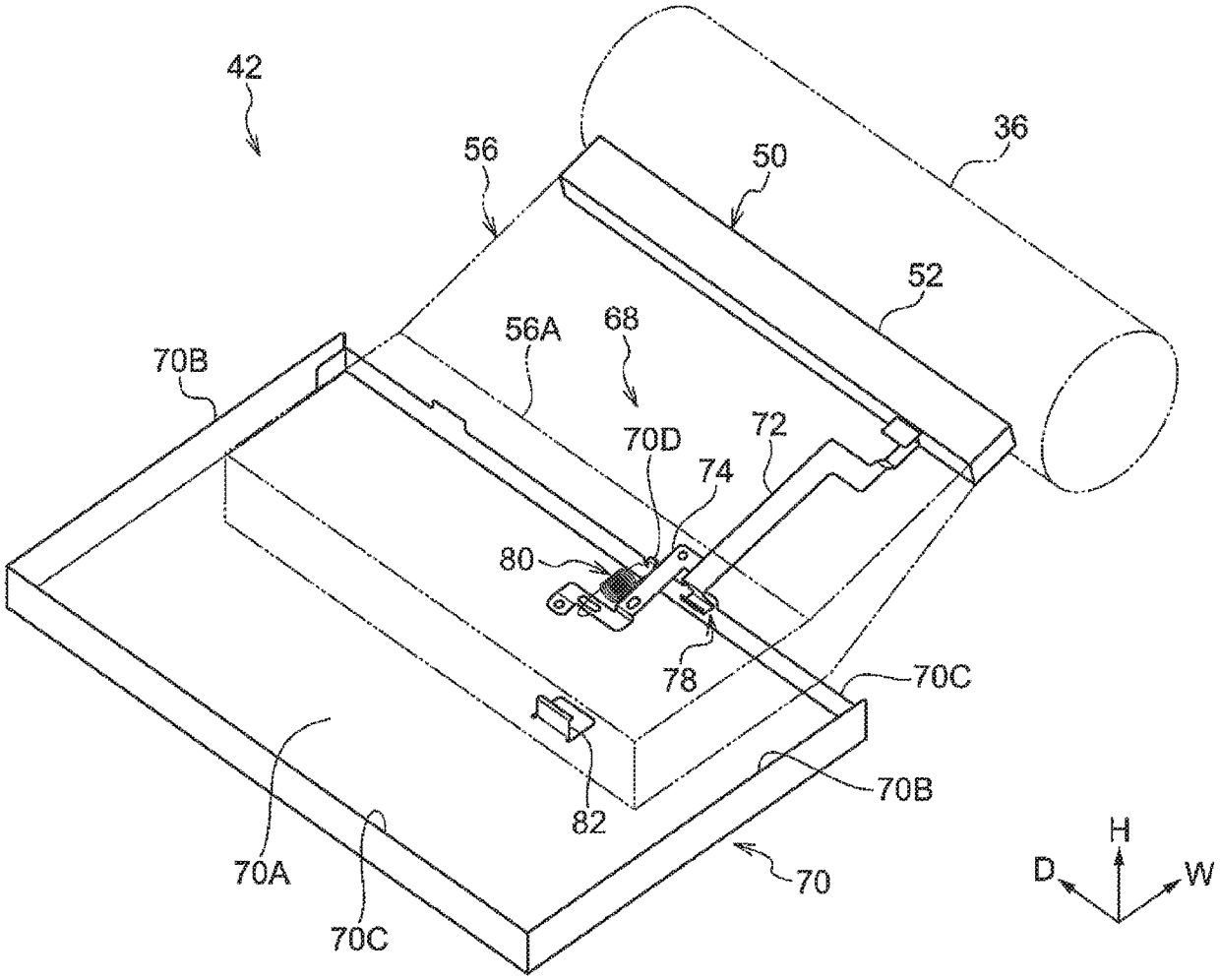
FIG. 4 is a perspective view of a grounding member and other components of an exposure unit included in the image forming apparatus according to the exemplary embodiment of the present invention.

As illustrated in FIG. 4, the grounding member 68 includes a frame member 70, which is attached to the housing 10A (see FIG. 1) and grounded; the coil spring 80, which is an example of a stretching member having a coil shape that is attached to the frame member 70 at a first end thereof; and first and second metal plate members 72 and 74, which are attached to the support member 56 of the exposure unit 42. The first and second metal plate members 72 and 74 are examples of a first member, and the frame member 70 is an example of a second member.

Frame Member

The frame member 70 is formed by bending a metal plate. As illustrated in FIGS. 4 and 12, the frame member 70 includes a rectangular body portion 70A, which have plate surfaces that face in the up-down direction of the apparatus and which extends in the depth direction of the apparatus in top view; and a pair of flange portions 70B, which project upward from both ends of the body portion 70A in the depth direction of the apparatus and which have plate surfaces that face in the depth direction of the apparatus. The frame member 70 also includes a pair of flange portions 70C, which project upward from both ends of the body portion 70A in the width direction of the apparatus and which have plate surfaces that face in the width direction of the apparatus.

As illustrated in FIG. 4, the body portion 70A includes a cut-and-raised portion 82 in a central region thereof in the width direction of the apparatus and a near region thereof (right region in FIG. 4) in the depth direction of the apparatus. The cut-and-raised portion 82 is raised upward and has plate surfaces that face in the width direction of the apparatus.

Figure 9:
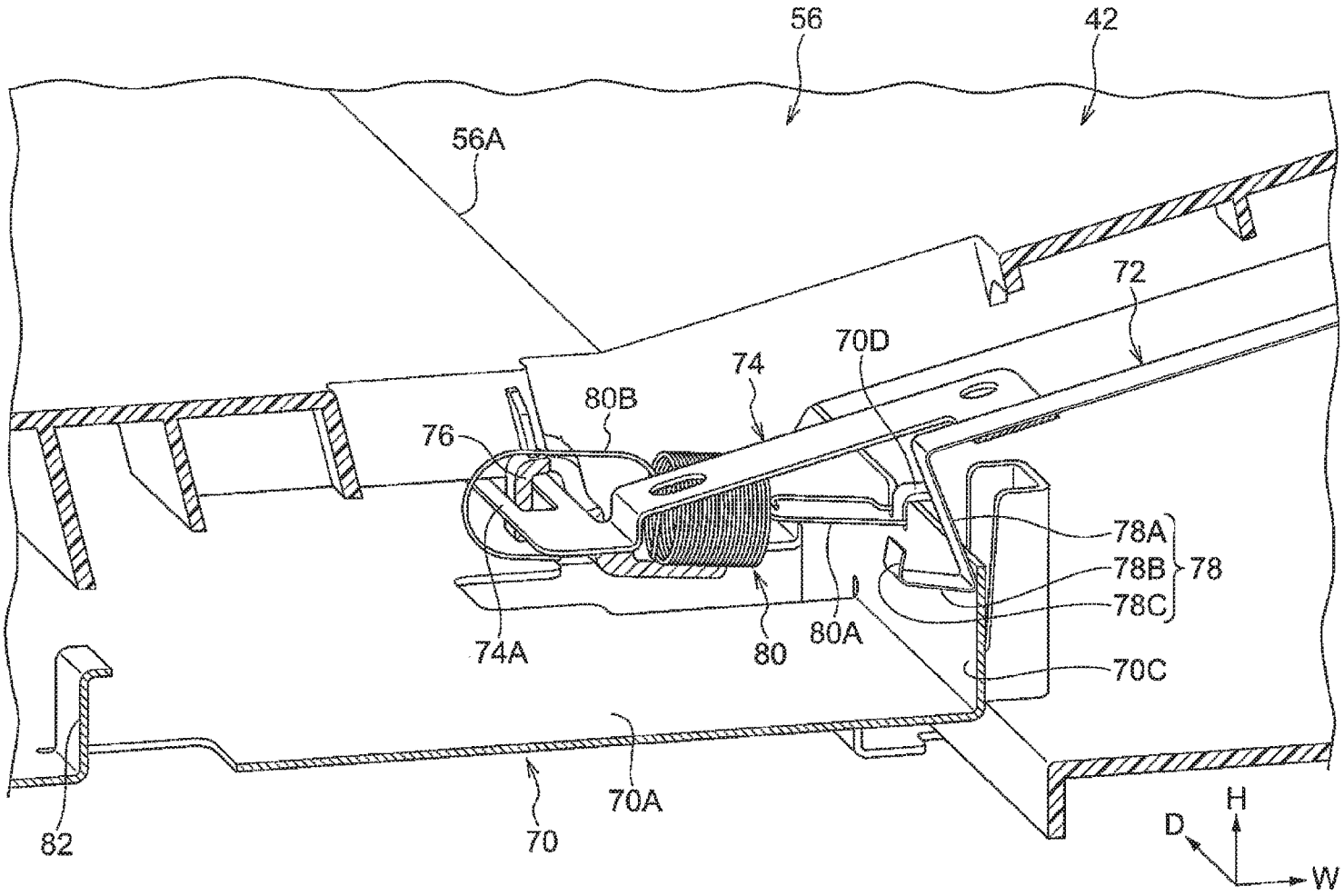
FIG. 9 is an enlarged perspective view of the grounding member and other components of the exposure unit included in the image forming apparatus according to the exemplary embodiment of the present invention.

As illustrated in FIGS. 4 and 9, one of the flange portions 70C that is closer to the image carrier 36 is provided with an L-shaped hook portion 70D.

Coil Spring

The coil spring 80 is a tension spring made of a metal that expands in the width direction of the apparatus. As illustrated in FIG. 9, a first end portion 80A of the coil spring 80 has an annular shape, and is hooked on the hook portion 70D of the frame member 70.

The second end portion 80B of the coil spring 80 also has an annular shape, and is placed on the rib 76 of the support member 56 of the exposure unit 42 when the exposure unit 42 is at the opposing position.

First and Second Metal Plate Members

The first metal plate member 72 is formed of a metal plate, and is fixed to the bottom surface of the support member 56 that faces downward. As illustrated in FIG. 4, a first end of the first metal plate member 72 is in contact with the housing 52 of the head 50, and a second end of the first metal plate member 72 extends beyond the bent portion 56A of the support member 56. The second metal plate member 74 is also formed of a metal plate, and is fixed to the bottom surface of the support member 56 that faces downward. A first end of the second metal plate member 74 is fixed to a second end portion of the first metal plate member 72, and a second end of the second metal plate member 74 extends in a direction away from the head 50.

The second end portion of the first metal plate member 72 includes a contact portion 78 that comes into contact with the flange portion 70C closer to the image carrier 36 when the exposure unit 42 is at the opposing position. More specifically, as illustrated in FIG. 9, the contact portion 78 includes a base portion 78A, which is formed by bending the second end portion of the first metal plate member 72 and which extends downward so as to come into contact with the flange portion 70C at the bottom end thereof. The contact portion 78 also includes an extending portion 78B that extends from the bottom end of the base portion 78A in a direction away from the flange portion 70C along the width direction of the apparatus, and a distal end portion 78C that extends upward from the end of the extending portion 78B.

When the contact portion 78 is in contact with the flange portion 70C, the contact portion 78 is in a state in which the end portion of the base portion 78A is bent by being pressed by the flange plate.

A first end portion of the second metal plate member 74 is bent toward the near side in the depth direction of the apparatus, and the bent portion is in contact with the bottom surface of the first metal plate member 72. A second end portion of the second metal plate member 74 includes an extending portion 74A that is bent toward the far side in the depth direction of the apparatus and extends toward the far side in the depth direction of the apparatus. When the exposure unit 42 is at the opposing position, the extending portion 74A extends through the second end portion 80B of the coil spring 80 without being in contact with the second end portion 80B of the coil spring 80.

In this structure, when the exposure unit 42 is at the opposing position, the contact portion 78 of the first metal plate member 72 is in contact with the flange portion 70C, so that the exposure unit 42 is grounded. Changes in the grounded state in response to the movement of the exposure unit 42 will be described in detail below together with the operation.

Opening-Closing Cover

Figure 3:
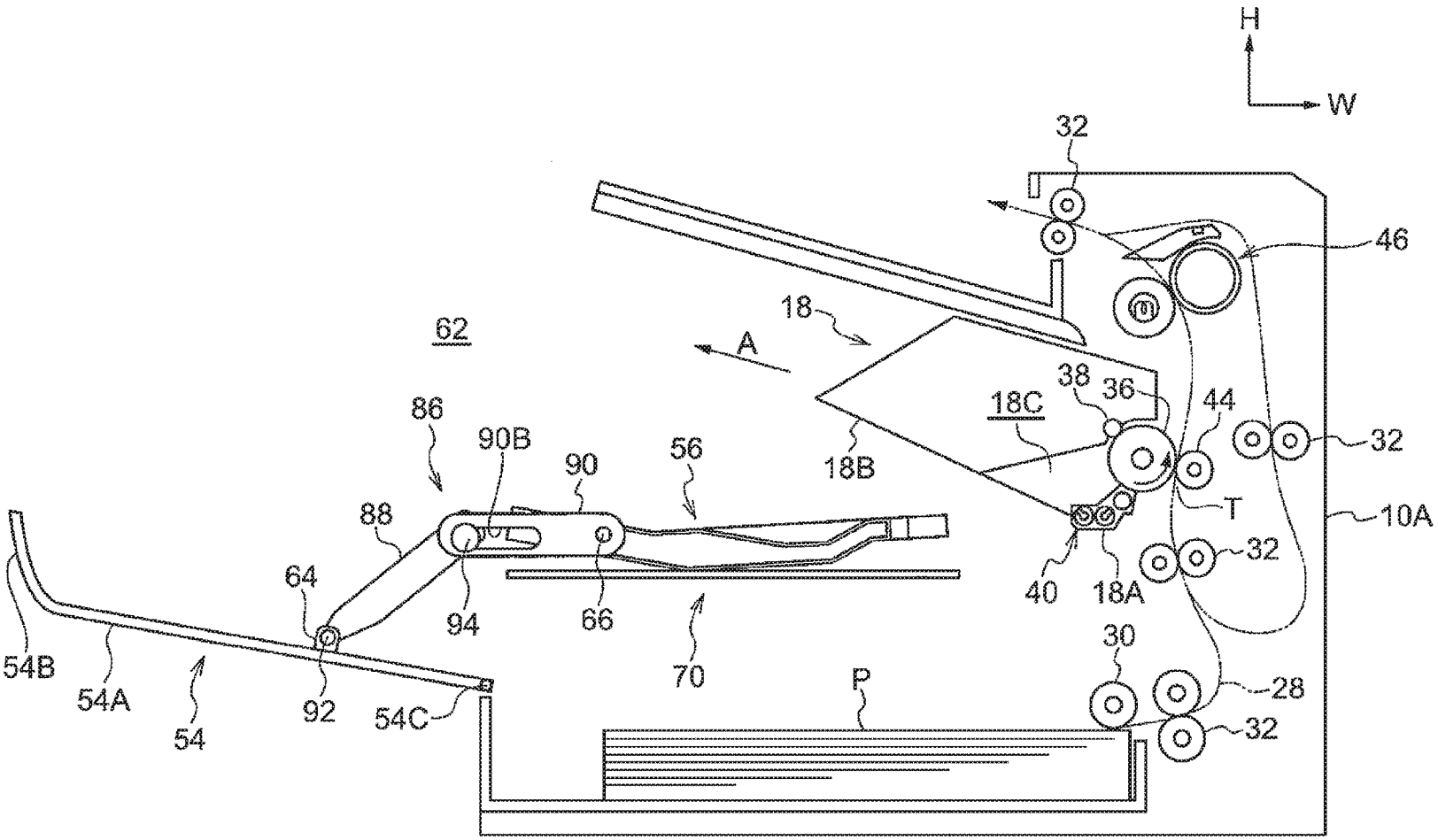
FIG. 3 is a schematic diagram illustrating the image forming apparatus according to the exemplary embodiment of the present invention.
Figure 8:
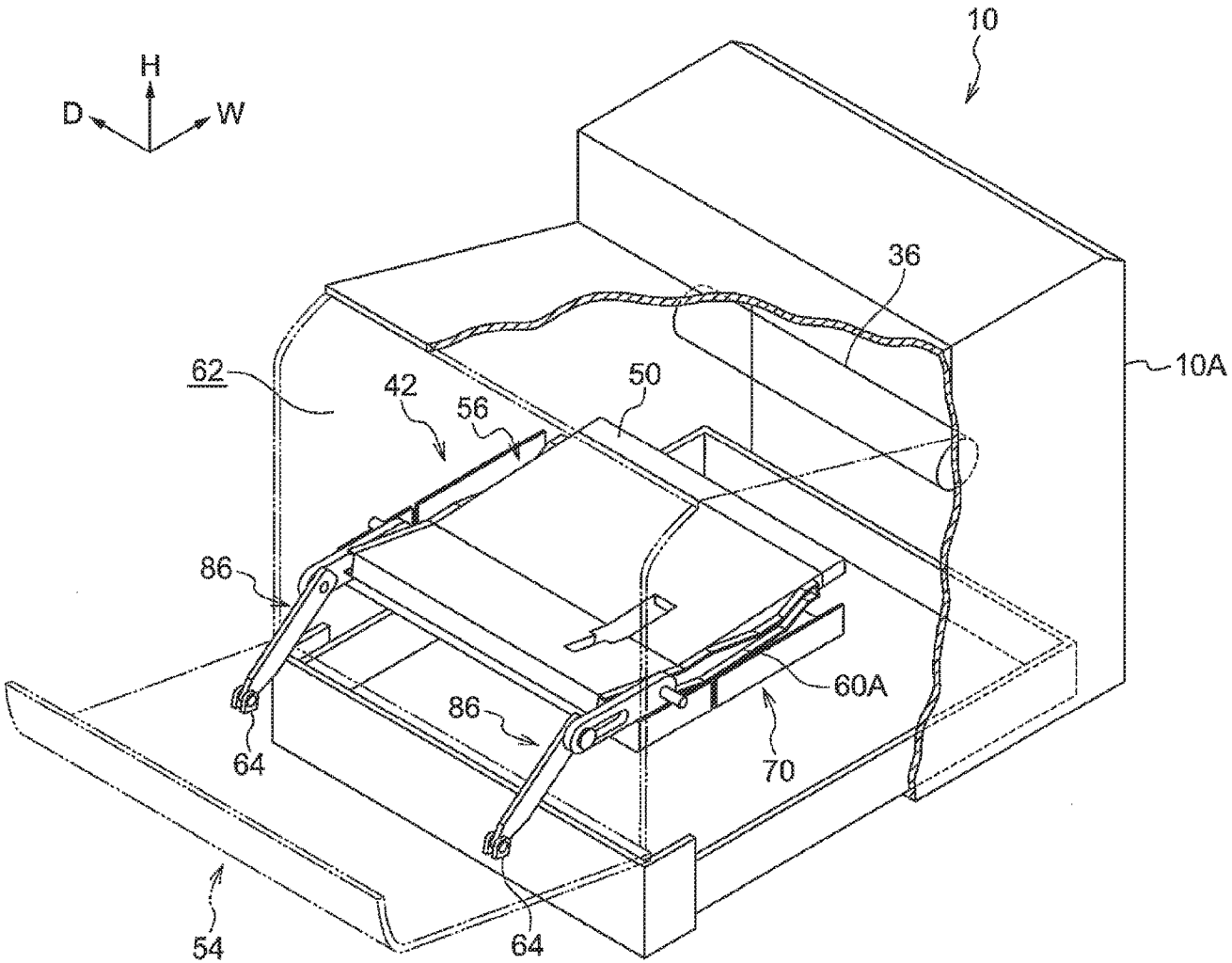
FIG. 8 is a perspective view of the image forming apparatus according to the exemplary embodiment of the present invention.

As illustrated in FIG. 8, the opening 62, which has a rectangular shape when viewed in the width direction of the apparatus, is formed in the housing 10A at a side opposite to the side at which the image carrier 36 is provided with the exposure unit 42 disposed therebetween. Referring to FIGS. 1 and 3, the opening-closing cover 54 rotates between a closed position, at which the opening-closing cover 54 closes the opening 62 (see FIG. 1), and an open position, at which the opening-closing cover 54 opens the opening 62 (see FIG. 3).

More specifically, when the opening-closing cover 54 is at the closed position, the opening-closing cover 54 includes a body portion 54A having plate surfaces facing in the width direction of the apparatus, and a curved portion 54B that extends from the top edge of the body portion 54A and that is curved toward the inside of the apparatus. In addition, a shaft 54C having an axis that extends in the depth direction of the apparatus is provided at the bottom end of the opening-closing cover 54.

In this structure, when the opening-closing cover 54 is rotated around the shaft 54C from the closed position illustrated in FIG. 1, the opening-closing cover 54 is stopped by a stopper (not shown) and retained at the open position illustrated in FIG. 3, where the opening-closing cover 54 opens the opening 62. When the opening 62 is opened, as illustrated in FIG. 3, a path along which the image forming unit 18 is moved in the direction of arrow A is formed.

Two attachment portions 64, to which end portions of the link mechanisms 86 described below are attached, are formed on the body portion 54A of the opening-closing cover 54 so as to be spaced from each other in the depth direction of the apparatus (see FIG. 12).

Link Mechanism

The link mechanisms 86 are members for moving the exposure unit 42 in response to the opening-closing movement of the opening-closing cover 54. As illustrated in FIG. 12, two link mechanisms 86 that sandwich the exposure unit 42 in the depth direction of the apparatus are provided.

Each link mechanism 86 includes a first arm 88, which includes a proximal end portion that is rotatably attached to the corresponding attachment portion 64, and a second arm 90, which includes a distal end portion that is rotatably attached to the corresponding end surface 58A or 58B of the exposure unit 42 and a proximal end portion that is rotatably attached to a distal end portion of the first arm 88.

More specifically, the proximal end portion of the first arm 88 is rotatably attached to the corresponding attachment portion 64 by a shaft member 92 having an axis that extends in the depth direction of the apparatus. A columnar pin 94 that extends outward in the depth direction of the apparatus (in a direction away from the exposure unit 42) is provided on the distal end portion of the first arm 88.

The support member 56 includes a columnar shaft 66, which extends outward in the depth direction of the apparatus, on each of the end surfaces 58A and 58B. The distal end portion of the second arm 90 is rotatably attached to the support member 56 by using the corresponding shaft 66. The proximal end portion of the second arm 90 has a long hole 90B that extends in the longitudinal direction of the second arm 90. The above-described pin 94 extends through the long hole 90B and is movable in the long hole 90B.

In this structure, when the opening-closing cover 54 is at the closed position, as illustrated in FIG. 1, the pin 94 is disposed at a first end of the long hole 90B (end closer to the shaft 66), and the exposure unit 42 is at the opposing position. When the opening-closing cover 54 is at the open position, as illustrated in FIG. 3, the pin 94 is at a second end of the long hole 90B, and the exposure unit 42 is at the retracted position.

The movement of the exposure unit 42 in response to the opening-closing movement of the opening-closing cover 54 will be described below together with the operation.

The operation of moving the opening-closing cover 54 from the closed position to the open position will now be described.

Figure 7:
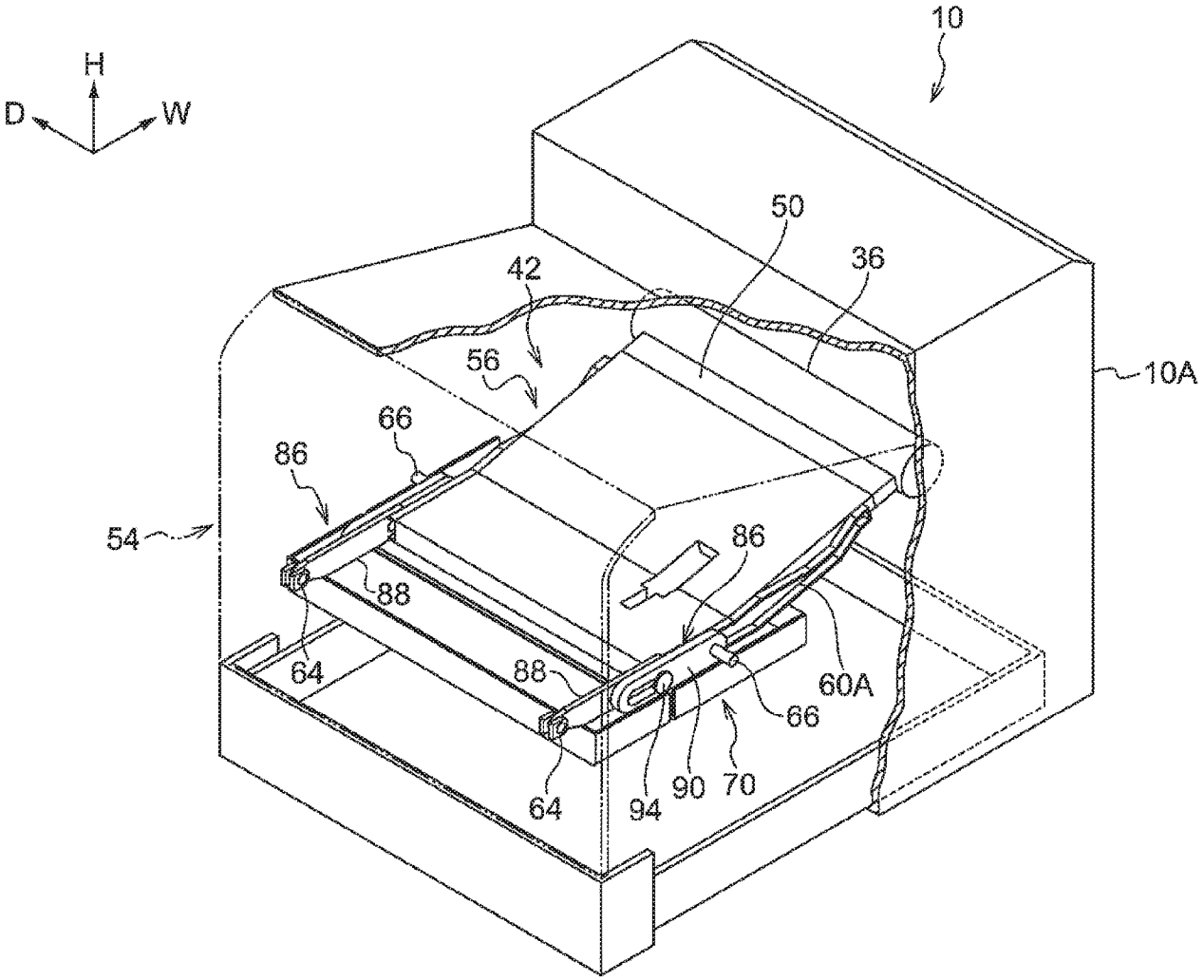
FIG. 7 is a perspective view of the image forming apparatus according to the exemplary embodiment of the present invention.

When the opening-closing cover 54 is at the closed position, as illustrated in FIGS. 1, 4, and 7, the exposure unit 42 is at the opposing position and a portion of the exposure unit 42 is disposed in the gap 18C formed in the image forming unit 18.

In addition, as illustrated in FIG. 9, in the state in which the base portion 78A of the contact portion 78 is bent, the contact portion 78 of the first metal plate member 72 is in contact with the flange portion 70C (first contact state). Thus, the exposure unit 42 is grounded. The second end portion 80B of the coil spring 80 is placed on the rib 76, and is separated from the extending portion 74A of the second metal plate member 74.

Figure 2:
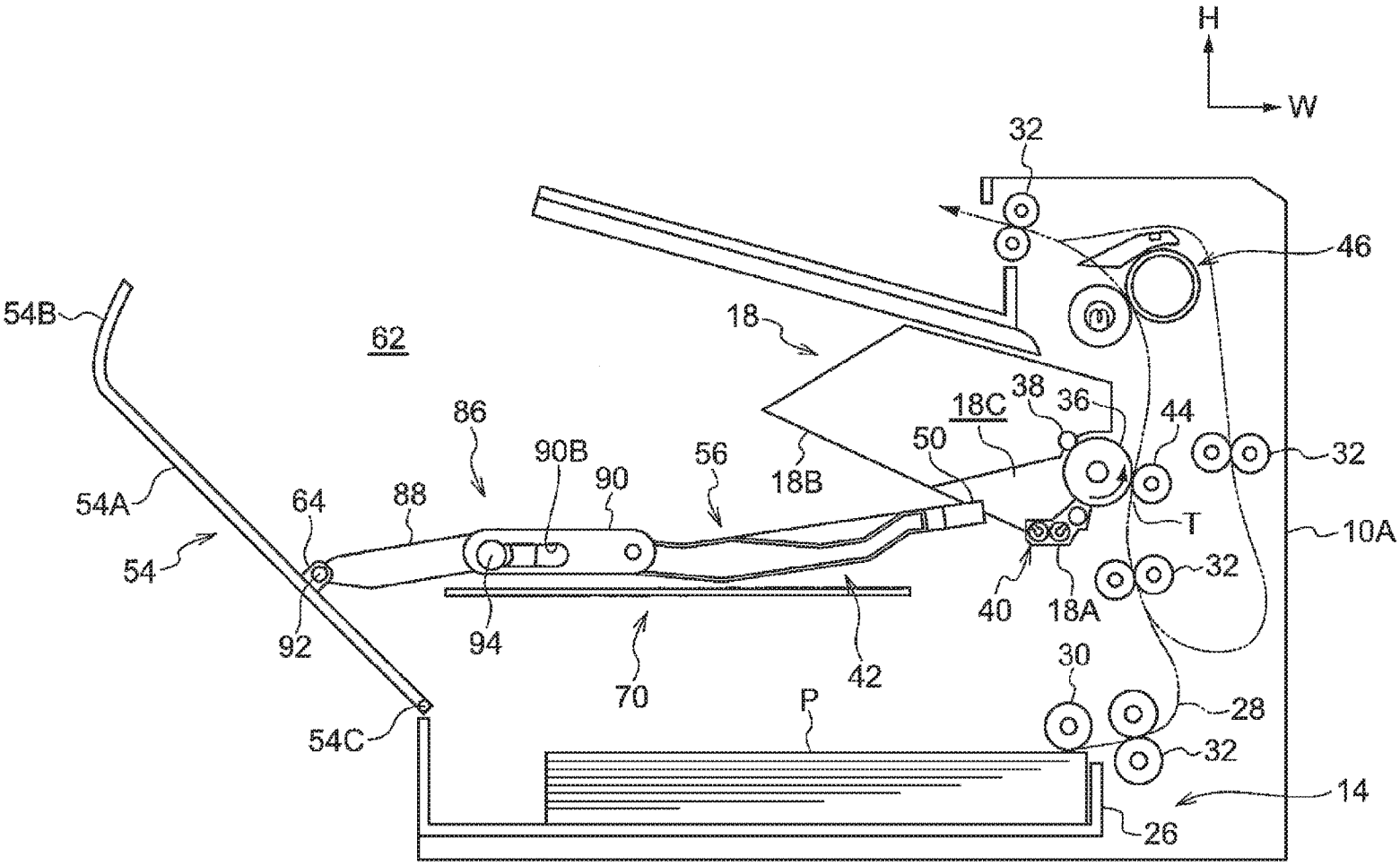
FIG. 2 is a schematic diagram illustrating the image forming apparatus according to the exemplary embodiment of the present invention.

In this state, the user holds a holder portion (not shown) and rotates the opening-closing cover 54 around the shaft 54C. Accordingly, as illustrated in FIG. 2, the opening 62 is opened from the upper portion thereof and the pin 94 of each of the link mechanisms 86 moves toward the second end of the long hole 90B. Each link mechanism 86 transmits the rotation force of the opening-closing cover 54 to the exposure unit 42 through the first arm 88 and the second arm 90.

The exposure unit 42 that has received the rotation force of the opening-closing cover 54 moves from the opposing position toward the retracted position while being guided by guide pins (not shown) having distal end portions inserted in the guide grooves 60A and 60B (see FIG. 12). Accordingly, the exposure unit 42 tries to move out of the gap 18C formed in the image forming unit 18.

Figure 5:
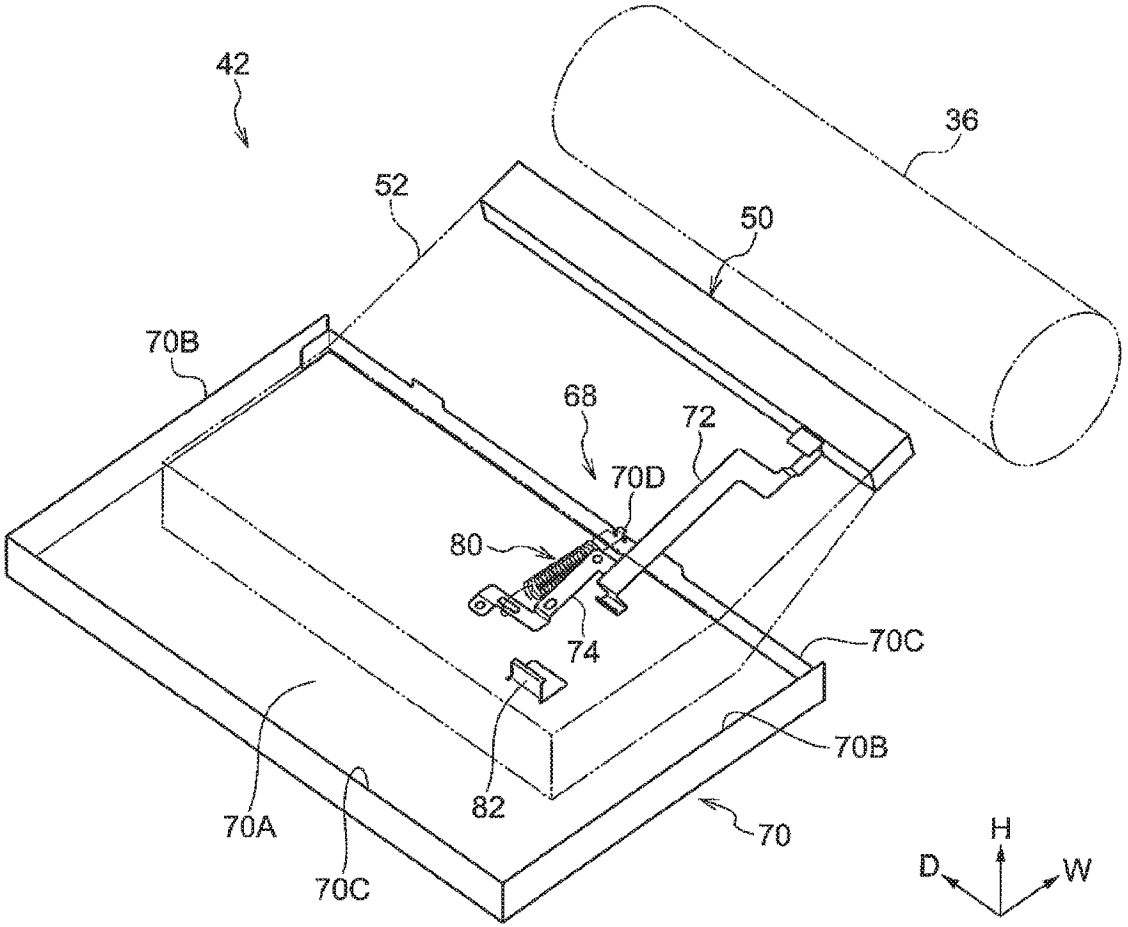
FIG. 5 is a perspective view of the grounding member and other components of the exposure unit included in the image forming apparatus according to the exemplary embodiment of the present invention.
Figure 10:
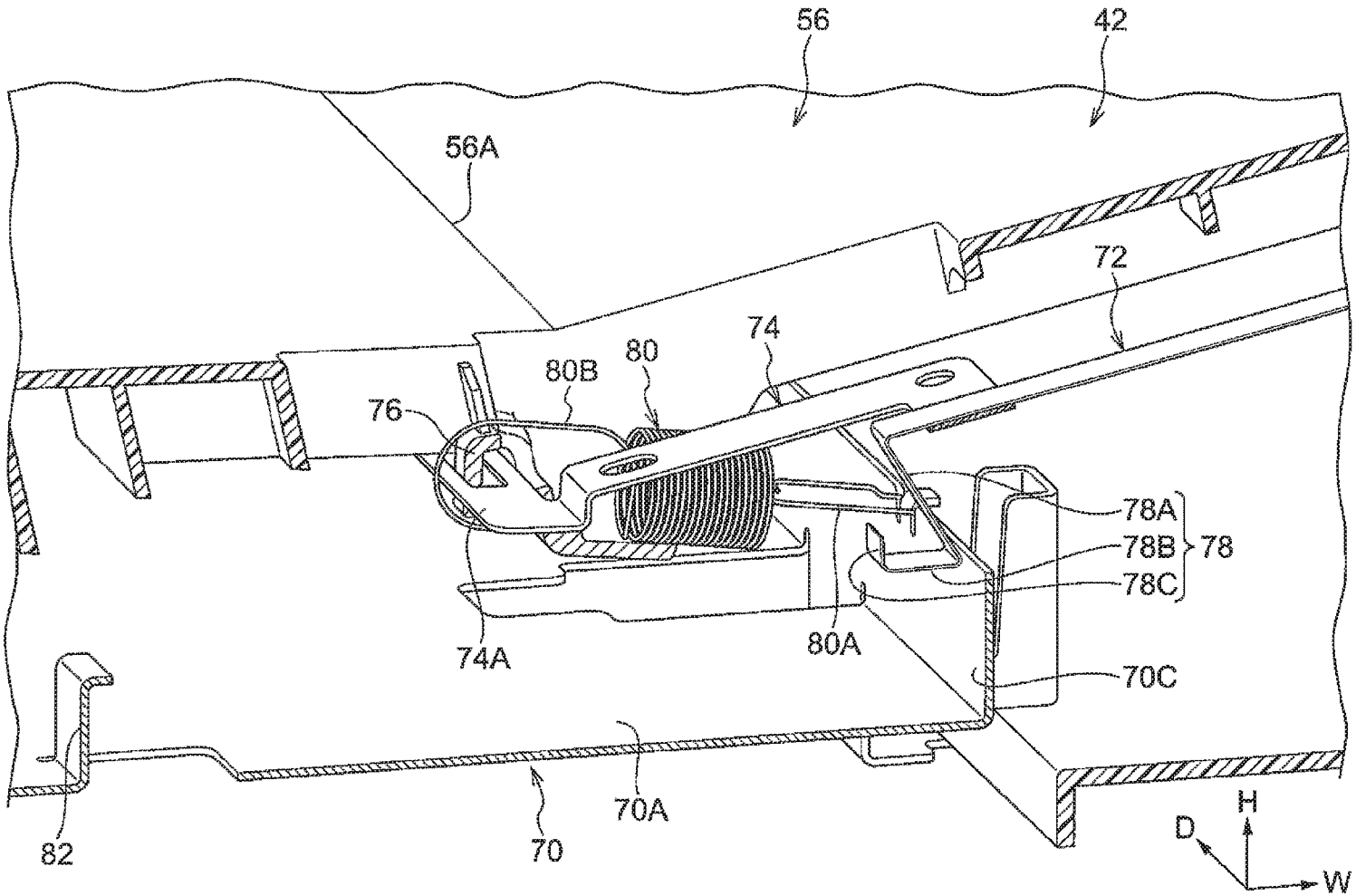
FIG. 10 is an enlarged perspective view of the grounding member and other components of the exposure unit included in the image forming apparatus according to the exemplary embodiment of the present invention.

During the movement of the exposure unit 42 from the opposing position to the retracted position, as illustrated in FIGS. 5 and 10, the contact portion 78 of the first metal plate member 72 moves away from the flange portion 70C, and the second end portion 80B of the coil spring 80 comes into contact with the extending portion 74A of the second metal plate member 74 (second contact state). Until the second end portion 80B of the coil spring 80 comes into contact with the extending portion 74A of the second metal plate member 74, the contact portion 78 and the flange portion 70C remain in contact with each other owing to the bending allowance of the base portion 78A of the contact portion 78. Thus, the exposure unit 42 is grounded.

Figure 6:
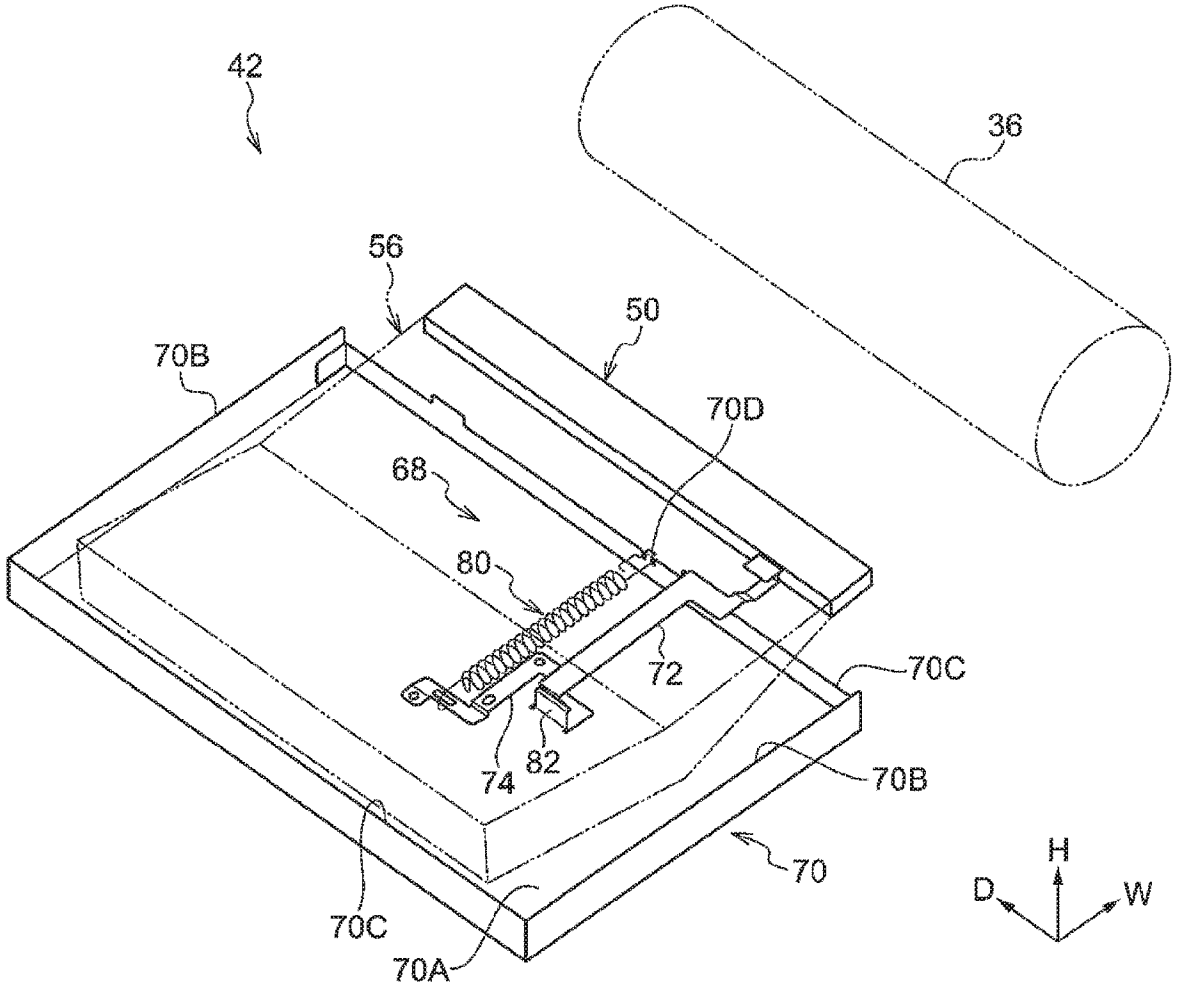
FIG. 6 is a perspective view of the grounding member and other components of the exposure unit included in the image forming apparatus according to the exemplary embodiment of the present invention.

When the opening-closing cover 54 is further rotated, the opening-closing cover 54 comes into contact with the stopper (not shown) and is retained at the open position, where the opening 62 is opened, as illustrated in FIGS. 3, 6, and 8. The link mechanisms 86 transmit the rotation force of the opening-closing cover 54 to the exposure unit 42, so that the exposure unit 42 moves while being guided by the guide pins (not shown) having distal end portions inserted in the guide grooves 60A and 60B (see FIG. 12) and is retained at the retracted position. Thus, the exposure unit 42 moves out of the gap 18C formed in the image forming unit 18.

Figure 11:
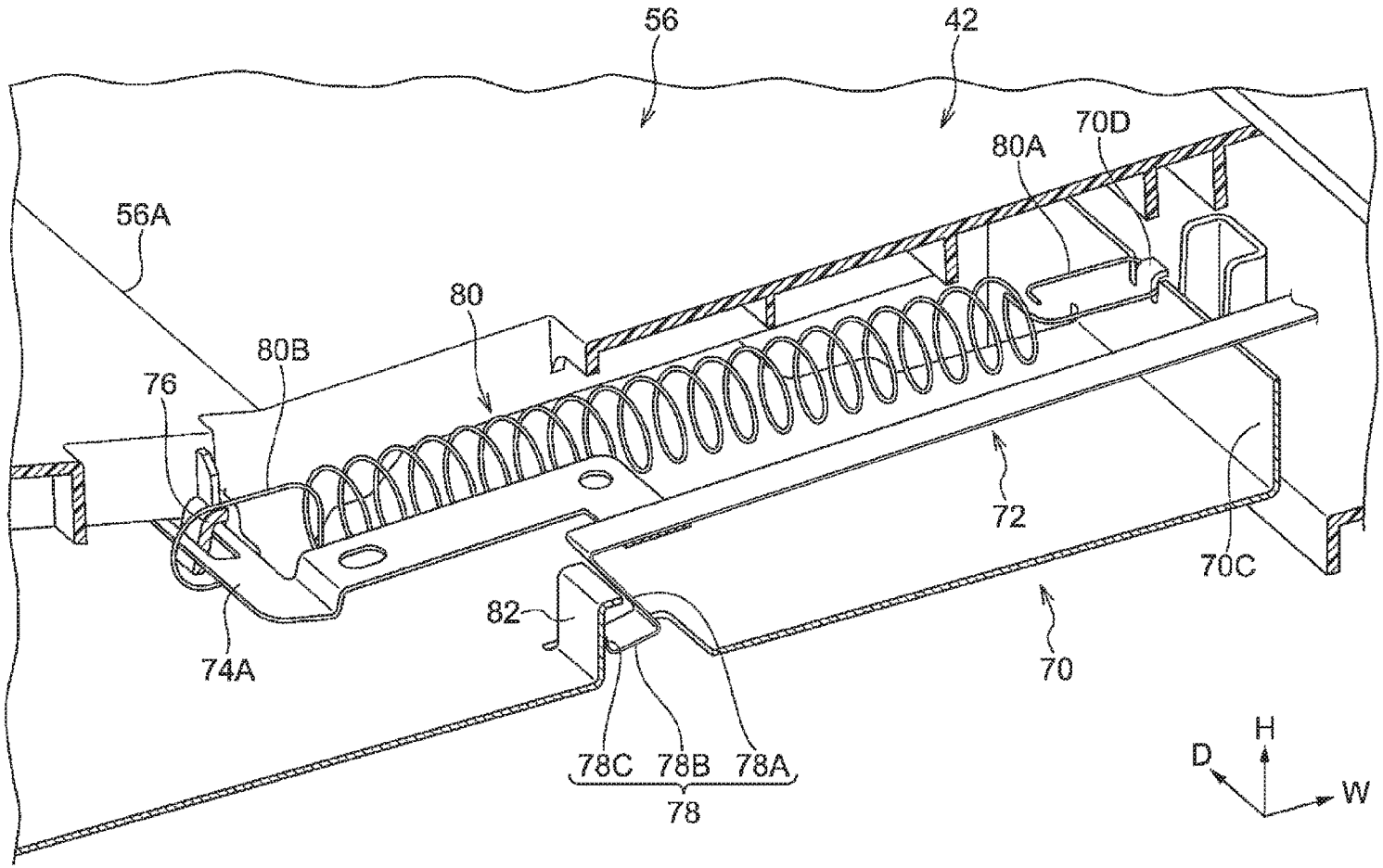
FIG. 11 is an enlarged perspective view of the grounding member and other components of the exposure unit included in the image forming apparatus according to the exemplary embodiment of the present invention.

When the exposure unit 42 is at the retracted position, as illustrated in FIG. 11, the second end portion 80B of the coil spring 80 is in contact with the extending portion 74A of the second metal plate member 74. In addition, the contact portion 78 of the first metal plate member 72 is in contact with the cut-and-raised portion 82 in such a manner that the base portion 78A of the contact portion 78 is bent (third contact state). Thus, the exposure unit 42 is grounded.

In this state, as illustrated in FIG. 3, the movement path for the image forming unit 18 is formed. Therefore, the user may remove the image forming unit 18 by inserting their hand through the opening 62 and moving the image forming unit 18 in the direction of arrow A.

To move the opening-closing cover 54 from the open position to the closed position, the opening-closing cover 54 disposed at the open position is rotated toward the closed position, so that the above-described steps are performed in the reverse order and the opening-closing cover 54 is disposed at the closed position.

SUMMARY

As described above, when the exposure unit 42 is moving from the opposing position to the retracted position, the second end portion 80B of the coil spring 80 is in contact with the extending portion 74A of the second metal plate member 74, so that the exposure unit 42 is grounded. When, for example, the user inserts their hand into the housing 10A while the opening-closing cover 54 is partially opened (see FIG. 2) and touches the exposure unit 42, the charge accumulated on the user may flow to the exposure unit 42 as static electricity. However, since the exposure unit 42 is grounded while the exposure unit 42 is moving from the opposing position to the retracted position, the risk that the exposure unit 42 will break is lower than that in the case where the exposure unit 42 is not grounded.

In addition, when the exposure unit 42 is at the opposing position, the extending portion 74A of the second metal plate member 74 is separated from the coil spring 80. Therefore, the occurrence of noise in the exposure unit 42 due to an antenna effect during the operation of the exposure unit 42 is lower than that in the case where the extending portion 74A is in contact with the coil spring 80, which is a wire member.

Although a specific exemplary embodiment of the present invention is described in detail, the present invention is not limited to the exemplary embodiment, and various exemplary embodiments are possible within the scope of the present invention. For example, although the extending portion 74A and the coil spring 80 are separated from each other when the exposure unit 42 is at the opposing position in the exemplary embodiment, they may instead be in contact with each other. In such a case, the effect obtained when the extending portion 74A and the coil spring 80 are separated from each other cannot be obtained.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an opening-closing member configured to rotate to open or close an opening in a housing;

an image carrier disposed in the housing;

an exposure member disposed in the housing, the exposure member being configured to move in response to an opening-closing movement of the opening-closing member so that the exposure member is at an opposing position, at which the exposure member opposes the image carrier, when the opening-closing member is at a closed position, at which the opening-closing member closes the opening in the housing and so that the exposure member is at a retracted position, at which the exposure member is retracted away from the image carrier, when the opening-closing member is at an open position, at which the opening-closing member opens the opening in the housing, the exposure member being configured to form an electrostatic latent image by performing an exposure process on the image carrier while the exposure member is at the opposing position;

a developing member configured to develop the electrostatic latent image; and a grounding member configured to ground the exposure member at least when the exposure member is between the opposing position and the retracted position.

2. The image forming apparatus according to claim 1, wherein the grounding member is configured to ground the exposure member also when the exposure member is at the opposing position, wherein the grounding member includes:

a first member that is attached to the exposure member;

a second member that is attached to the housing and grounded; and a stretching member having a coil shape that is attached to the housing, and wherein the image forming apparatus is configured such that, when the exposure member is at the opposing position, the first member and the second member are in contact with each other and the first member and the stretching member are separated from each other, and when the exposure member is moving from the opposing position to the retracted position, the first member and the second member become separated from each other in response to the movement of the exposure member, and the first member and the stretching member come into contact with each other in response to the movement of the exposure member before the first member the second member become separated from each other.

3. The image forming apparatus according to claim 2, wherein the image forming apparatus is configured such that, when the exposure member is moving from the opposing position to the retracted position, the stretching member remains in contact with the first member by being stretched by the first member in response to the movement of the exposure member, so that the exposure member is grounded.

4. The image forming apparatus according to claim 3, wherein the image forming apparatus is configured such that, when the opening-closing member is at the open position, the first member and the second member are in contact with each other.

5. The image forming apparatus according to claim 2, wherein the image forming apparatus is configured such that, when the opening-closing member is at the open position, the first member and the second member are in contact with each other.

6. The image forming apparatus according to claim 1, wherein the grounding member is configured to ground the exposure member when the exposure member is at all positions between the opposing position to the retracted position.

7. The image forming apparatus according to claim 6, wherein the grounding member is configured to ground the exposure member when the exposure member is at the opposing position and the retracted position.

8. An image forming apparatus comprising:

an opening-closing member configured to rotate to open or close an opening in a housing;

an image carrier disposed in the housing;

an exposure member disposed in the housing, the exposure member being configured to move in response to an opening-closing movement of the opening-closing member so that the exposure member is at an opposing position, at which the exposure member opposes the image carrier, when the opening-closing member is at a closed position, at which the opening-closing member closes the opening in the housing and so that the exposure member is at a retracted position, at which the exposure member is retracted away from the image carrier, when the opening-closing member is at an open position, at which the opening-closing member opens the opening in the housing, the exposure member being configured to form an electrostatic latent image by performing an exposure process on the image carrier while the exposure member is at the opposing position;

a developing member configured to develop the electrostatic latent image; and a grounding member configured to ground the exposure member at least when the exposure member is moving from the opposing position to the retracted position, wherein the grounding member is configured to ground the exposure member also when the exposure member is at the opposing position, wherein the grounding member includes:

a first member that is attached to the exposure member;

a second member that is attached to the housing and grounded; and a stretching member having a coil shape that is attached to the housing, and wherein the image forming apparatus is configured such that, when the exposure member is at the opposing position, the first member and the second member are in contact with each other and the first member and the stretching member are separated from each other, and when the exposure member is moving from the opposing position to the retracted position, the first member and the second member become separated from each other in response to the movement of the exposure member, and the first member and the stretching member come into contact with each other in response to the movement of the exposure member before the first member the second member become separated from each other.

* * * * *